US005259405A

United States Patent [19]

Hua-Chou

[11] Patent Number: 5,259,405

[45] Date of Patent: * Nov. 9, 1993

[54] STRUCTURE OF A BARETTE

[76] Inventor: Kuo Hua-Chou, Suite 1, 11F, 95-8 Chong Ping Road, Sec. 1, Taichung, Taiwan

[ * ] Notice: The portion of the term of this patent subsequent to Jan. 26, 2010 has been disclaimed.

[21] Appl. No.: 826,884

[22] Filed: Jan. 29, 1992

[51] Int. Cl.[5] ..... A45D 8/22

[52] U.S. Cl. ..... 132/279; 132/278

[58] Field of Search ..... 132/275, 276, 277, 278, 132/279

[56] References Cited

U.S. PATENT DOCUMENTS

| | | | |
|---|---|---|---|
| 2,168,369 | 8/1939 | Solomon | 132/278 |
| 2,170,636 | 8/1939 | Graham | 132/278 |
| 2,170,778 | 8/1939 | Huppert | 132/278 |
| 2,461,934 | 2/1949 | Solomon | 132/278 |
| 2,513,166 | 6/1950 | Goodman | 132/278 |
| 3,055,377 | 9/1962 | Guinett et al. | 132/275 |
| 3,704,717 | 12/1972 | Morand et al. | 132/279 |
| 4,991,607 | 2/1991 | Chen | 132/278 |

FOREIGN PATENT DOCUMENTS

| | | | |
|---|---|---|---|
| 2455444 | 1/1981 | France | 132/279 |
| 440897 | 10/1949 | Italy | 132/279 |

*Primary Examiner*—Gene Mancene
*Assistant Examiner*—Frank A. LaViola

[57] ABSTRACT

A barette for clipping hair made entirely from metal stampings comprises an elongate arcuate first clamp member and second clamp member. The first clamp member has a folded section formed on either end thereof by folding over the terminal end portions of the sheet metal blank from which the member is formed. As embossed raised portion formed centrally on each folded section defines a receiving space therein for a hinge insert and locking insert. A pair of elongate extensions formed on the hinge insert enable pivotable attachment to a corresponding end of the second clamp member, and a pair of elastic extensions on the locking insert enable releasable securement with a hasp provided on the opposing end of the second clamp member. Retaining appendages formed on the base of both the hinge insert and locking insert engage corresponding mating surfaces provided on their respective folded sections to fixedly secure the inserts in the receiving spaces after sliding insertion therein.

23 Claims, 4 Drawing Sheets

STRUCTURE OF A BARETTE

BACKGROUND OF THE PRESENT INVENTION

The present invention relates to barettes for clamping hair and more particularly to metallic barettes manufactured by sheet metal stamping processes and having a structure amenable to low cost and highly automated production as compared with more conventional barette structures of this type.

Though barette structures comprised entirely of components made by metal stampings are known and have a long history, hitherto the structural details of the more conventional barettes have not embodied maximum efficiency in material usage with much of the sheet metal stock being wasted as blank space between the stamping dies. This is due in large part to the requirements of the end portions of the barettes which must carry various appendages for hinged and locking engagements between corresponding ends of the two elongate clamping members from which the barette is comprised. As these are usually formed by stamping metal extending laterally to either side of the metal strip which forms the main body of the eventual clamping member, the material extending longitudinally between the lateral extremities is usually unexploited and discarded.

To attain a greater efficiency of material usage, the barette structure of the present invention employs separately formed inserts carrying hinging and locking appendages that are snap engaged within cooperating receiving spaces formed on opposite ends of the main clamping member. As both the main strip of the clamping member and the inserts can be formed by stamping operations on sheet metal strips of comparable width with the finished elements, little or no material is wasted. Moreover, the barettes can be formed by stamping operations on continuous strips using multistage dies, allowing for a highly automated and rapid production.

SUMMARY OF THE PRESENT INVENTION

The present invention has as main object to provide a barette structure that can be rapidly and economically manufactured by sheet metal stamping operations, wherein the barette comprises a pair of elongate and arcuate clamping members being pivotably joined on corresponding ends thereof and having mating locking appendages on the opposite ends.

Each end of a first clamping member has a folded section with a raised embossed portion defining a receiving space formed thereon by stamping operations on a continuous metal strip of equal width with the completed clamping members. A hinge insert and a locking insert also formed by metal stamping processes are fixedly disposed within the receiving spaces on corresponding ends of the clamping member, each insert having upwardly projecting appendages formed thereon for pivotable or releasably securable engagement with mating elements on the corresponding ends of the second clamping member. The disposition of the receiving spaces and the orientation of the entrance slits thereof differ among various embodiments. Accordingly, the specificaties of form of the inserts are also adapted to suit the various geometries therein, though all inserts are assembled by a simple snap fitting in all embodiments.

A more thorough and complete understanding of the present invention will be attained by referring to the detailed description of the preferred embodiments thereof provided below along with accompanying drawings.

A BRIEF DESCRIPTION OF THE DRAWINGS

A DETAILED DESCRIPTION OF THE PREFERRED EMBODIMENTS

Figure 1:
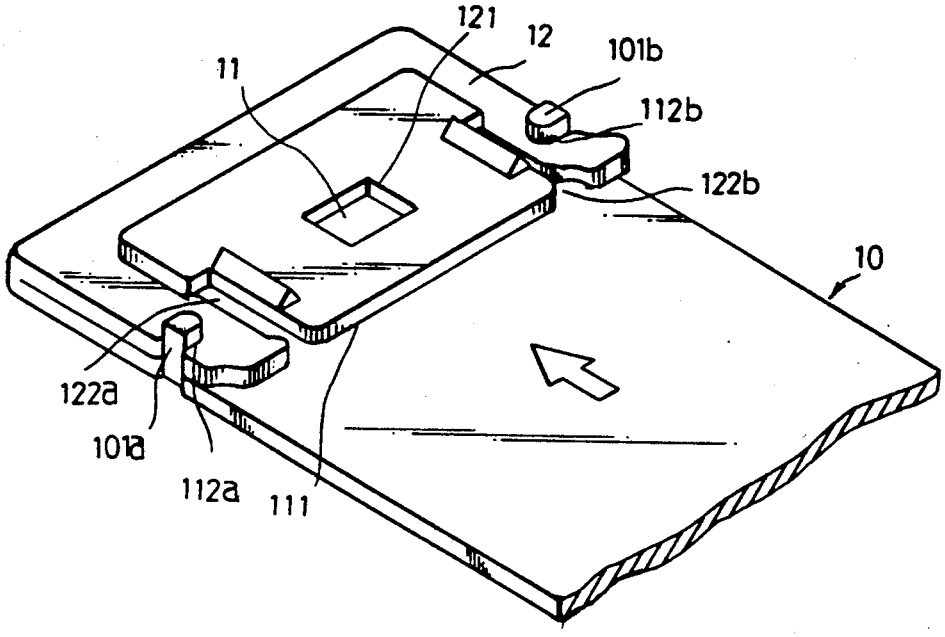
FIG. 1 is a perspective view showing a lateral end portion of a first member of a barette in accordance with a first embodiment of the present invention.
Figure 2:
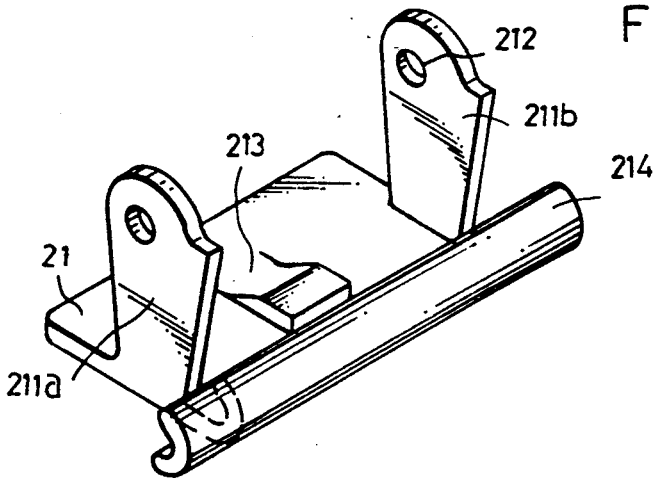
FIG. 2 is a perspective view of a hinge insert of the barette structure of the first embodiment.
Figure 3:
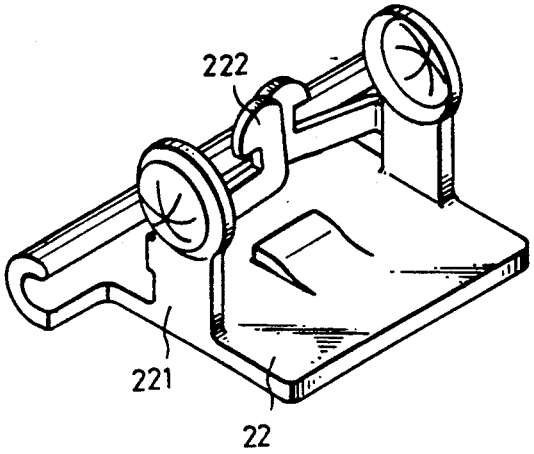
FIG. 3 is a perspective view of a locking insert of the barette structure of the first embodiment.

With reference to FIGS. 1 to 3, a first embodiment of the barette structure of the present invention comprises an arcuate, elongate first member 10 having generally rectangular receiving spaces 11 formed on either lateral end portion thereof, and a hinge insert 21 and a locking insert 22 to be received and retained within corresponding receiving spaces 11 thereon.

First member 10 is formed by stamping operations on a sheet metal strip having the lateral end portions thereof folded over into abutment with the top surface so as to define a folded section 12 on each end of the member. Each receiving space 11 is defined within an embossed, raised section formed roughly in a central position on a respective folded section 12, having a narrow entrance slit 111 formed adjacently to the inner edge of the folded section. A pair of notches, **112*a* and 112*b*, are formed on opposing edges of each folded section 12, parallel with the longitudinal direction of the member, near respective inner edges thereof. Each pair of notches is in registry with a corresponding pair of incised retaining tabs, 101*a* and 101*b***, formed therebelow, with the retaining tabs being folded over and in abutment with the upper surface of a corresponding folded section so as to secure its orientation on the member.

Figure 4:
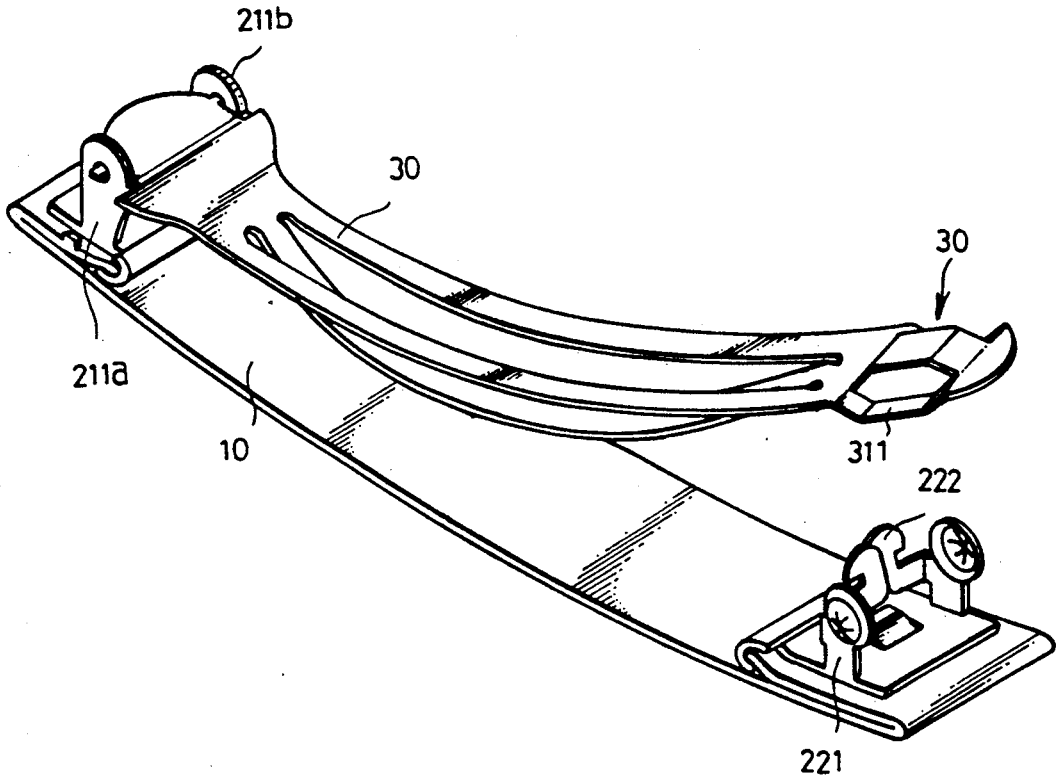
FIG. 4 is a perspective view showing a lateral end portion of a first member of a barette in accordance with a second embodiment, along with a hinge insert to be longitudinally received therein.

Hinge insert 21 has a generally rectangular base and a pair of elongate extensions **211*a* and 211*b* projecting upwardly from opposite lateral edges thereof. A pivot hole 212 is formed on the end portion of each extension to allow the pivoting attachment of a corresponding end of a second member 30, as shown in FIG. 4. Retaining appendages on the hinge insert which is adapted to be inserted within a corresponding folded section 12 engage cooperating mating surfaces thereon to secure the position of the hinge insert. A first retaining appendage, in the form of a generally rectangular and resilient tab 213 incised in a central position on the base thereof, engages a generally rectangular aperture 121 formed on the corresponding folded section 12 over the receiving space therein. The resilient tab 213 is upwardly inclined and snap fits into aperture 121 upon insertion of the hinge insert and abuts an edge of the aperture to prevent retraction therefrom. An upturned, curled rim 214 formed along the inner edge of the hinge insert defines a second retaining appendage which abuts an inner edge of the folded section over the entrance slit 111 to the receiving slit, blocking further insertion therein. A pair of guide slots, 122***a* and 122*b*, are formed on each folded section 12 on opposing sides of the receiving space therein parallel with the longitudinal direction of the first member for receiving respective extensions, 211*a* and 211*b*, of the hinge insert.

Locking insert 22 has a rectangular base and similar retaining appendages thereon for securement within the receiving space of a folded section on an opposing end of the first member. The extensions 221 projecting upwards from the lateral edges thereof, however, differ from those of the hinge insert in carrying a pair of roughly L-shaped bars 222 which are engageable with a hasp 31 provided on a corresponding end of the second member 30. Each L-shaped bar assumes a perpendicular angle with a respective extension 221 extending inwardly therefrom, and overlaps the other along vertically aligned sections thereof. As the extensions are resilient and can be manually pressed inwards, the vertical sections of each bar 222 which have enlarged ends define an elastic catch of adjustable width adapted to be receivable between the locking bars 311 of the cooperating hasp. Corresponding ends of the first member 10 and a second member 30 can thus be latched together for clamping a hair bundle. An assembled barette according to the first embodiment is shown in FIG. 4, the second member thereof being pivotably attached on a corresponding end to the first member with inserts in place therein.

Figure 5:
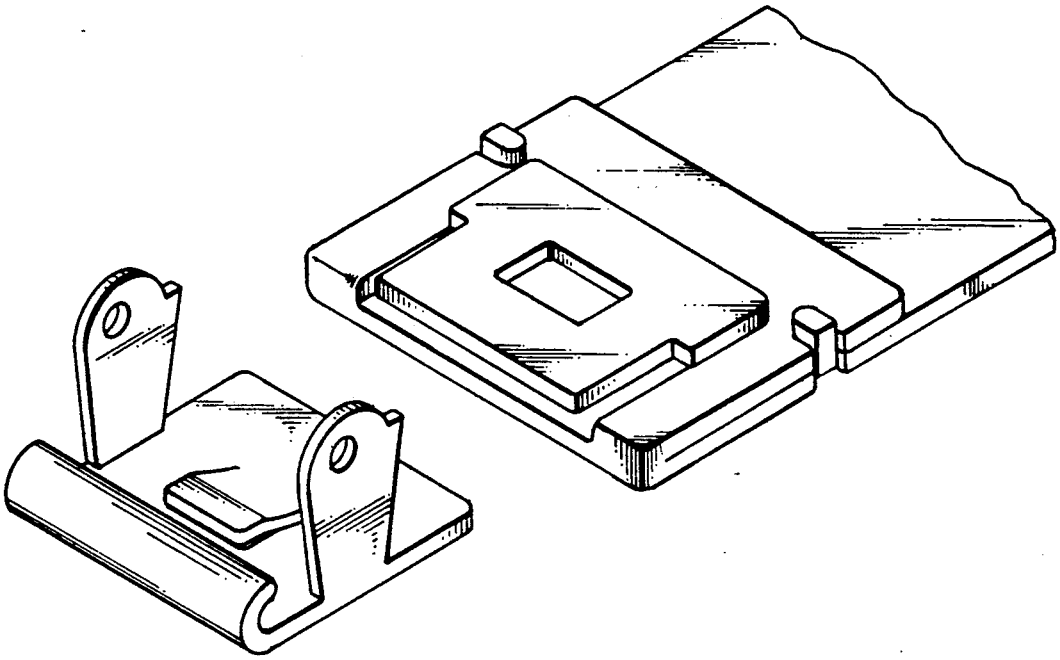
FIG. 5 is a perspective view showing a lateral end portion of a first member of a barette in accordance with a third embodiment, along with a hinge insert to be longitudinally received therein.

FIG. 5 shows a second embodiment of the barette structure of the present invention wherein a hinge insert 41 is disposed within a receiving space 51 of a corresponding folded section 52 through an entrance slit 511 formed near the outer, folded edge thereof. The hinge insert and corresponding folded section and receiving space therein are largely identical with those of the first embodiment with the exception that the entrance slit 511 is formed on an opposite side of the raised portion and the guide slits 512 for the extensions of insert 41 accordingly extend inwardly therefrom. A locking insert (not shown) similar with that of the previous embodiment is disposed within the folded section on the opposite end of the member.

Figure 6:
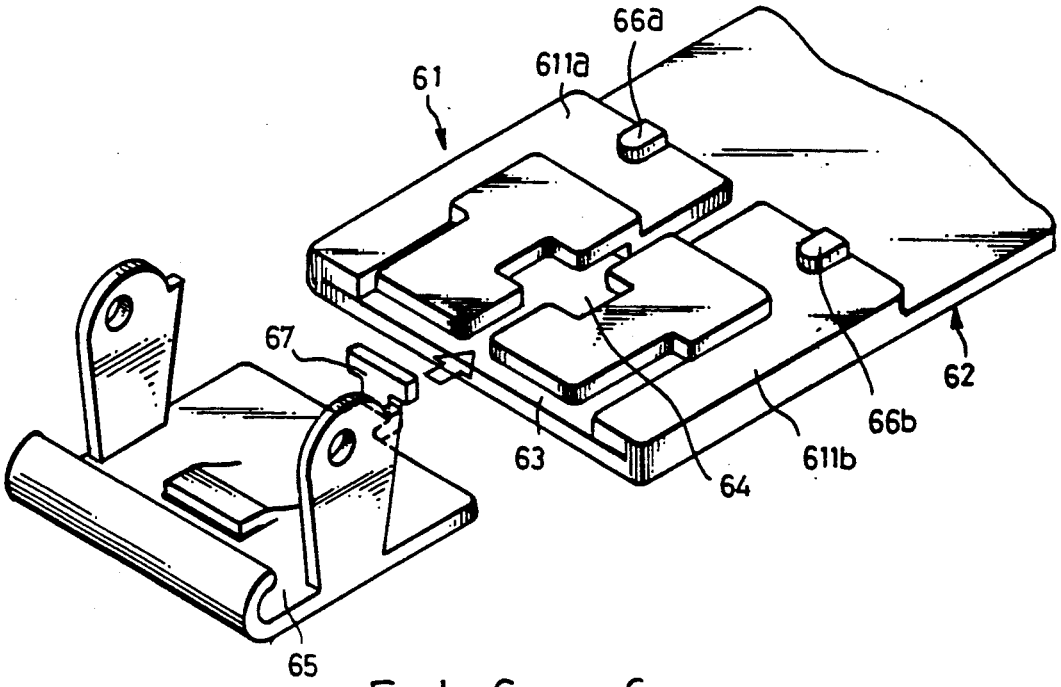
FIG. 6 is a perspective view showing a lateral end portion of a first member of a barette in accordance with a fourth embodiment, along with a hinge insert to be laterally received therein.

An alternate embodiment of a barette structure wherein the inserts are also slid through the outer lateral ends of the first member thereof is shown in FIG. 6. This embodiment differs from the prior in the manner of manufacture of the folded section 61 therein, being formed from laterally protruding plates 611*a* and 611*b* of the first member 62 which have been folded across the member into abutment with the upper surface thereof. The inner edge of each folded plate approaches that of the other and have raised portions and notches formed therein to define a receiving space with an outer entrance slit 63 and retaining aperture 64 for a hinge insert 65. A pair of incised retaining tabs 66*a* and 66*b* formed inwards from the lateral edges of the member clamp respective plates 611*a* and 611*b* in position. A generally T-shaped bar 67 formed centrally on the inner edge of hinge insert 65 slides along the gap defined between plates 611*a* and 611*b* when the insert is received within the receiving space and further aids in preventing the plates from spreading apart.

Figure 7:
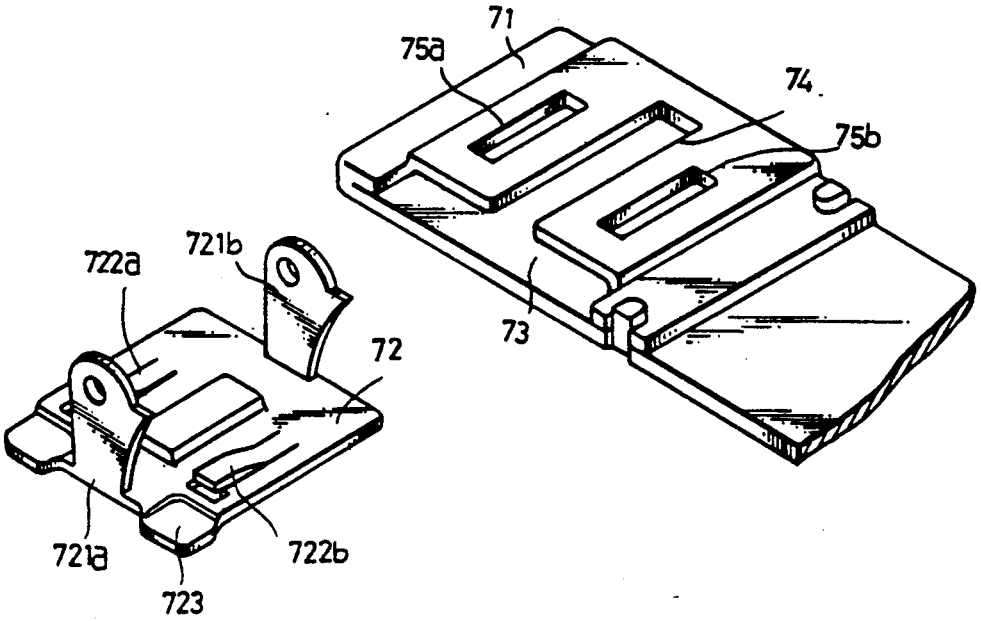
FIG. 7 is a perspective view showing an assembled barette structure in accordance with the first embodiment.

A final embodiment shown in FIG. 7 exemplifies a folded section 71 and hinge insert 72 wherein insertion is made from a lateral side of the folded section in a direction perpendicular with the longitudinal dimension of the member. A receiving space defined within a raised portion of folded section 71 has an entrance slit 73 formed near a lateral edge thereof and parallel therewith, and a rectangular guide slot 74 extending perpendicularly inward from the entrance slit. Extensions 721*a* and 721*b* on opposing edges of the hinge insert slide into the guide slot 74 when the insert is disposed within the receiving space. Concomitantly, a pair of incised, resilient tabs 722*a* and 722*b* formed on the hinge insert and inclined upwardly therefrom engage respective apertures 75*a* and 75*b* over the receiving space to retain the insert therein.

A pair of generally square shaped indentations 723 are formed on opposing corners of hinge insert 72 on the lateral side thereof adjacent to the entrance slit when the insert is inserted into the receiving space, serving to wedge the insert in place therein and prevent wobbling.

Though the above description contains many specificities these should not be interpreted as limitations on the scope of the present invention but merely as specific modes of actualization of preferred embodiments thereof. Many modifications and variations could be made by a person of average skill in the art without departing from the spirit or scope of the present invention which as such should be determined from the appended claims and their legal equivalents.

I claim:

1. A barette for clipping hair comprising a first and second arcuate, elongate members pivotably attached to each other on corresponding end portions thereof with at least said first member being formed from and assembled by metal stamping operations, wherein:

a folded section is formed on each lateral end portion of said first member by folding over the terminal end portions of a sheet metal strip from which said first member is formed so as to be in abutment with the top surface thereof;

a raised portion embossed on each said folded section defines a respective pair of receiving spaces thereon, each said receiving space having an entrance slit formed along an inner edge of a corresponding said folded section;

a hinge insert adapted to be received within a first said receiving space has a pair of upwardly projecting extensions formed on respective opposing sides thereof parallel with the longitudinal dimension of said first member, each said extension having a pivot hole thereon for the pivotable securement of a corresponding end of said second member;

a locking insert adapted to be received within a second said receiving space has cooperating resilient catch surfaces formed thereon adapted for engaging a latching means provided on a corresponding end of said second member; and retaining surfaces on said hinge insert and said locking insert engage cooperating surfaces on respective said receiving spaces to effect the securement of said hinge and locking inserts therein.

2. A barette according to claim 1, wherein two pairs of incised retaining tabs are formed under respective said folded sections at predetermined positions on opposing edges of said first member parallel with the longitudinal direction thereof, and a pair of notches are formed on respective opposing edges of each said folded section near the inner edge thereof being in registry with a corresponding pair of said retaining tabs, said retaining tabs being folded over and in abutment with the upper surface of said folded section.

3. A barette according to claim 1, wherein said receiving spaces, said hinge insert, and said locking insert have a generally rectangular form.

4. A barette according to claim 3, wherein a pair of guide slots are formed on opposing sides of each said receiving space parallel with the direction of insertion of said hinge and locking inserts therein, for receiving respective said extensions on corresponding said hinge and locking inserts.

5. A barette according to claim 4, wherein a pair of raised embossed grooves are formed on each said folded section over said receiving space therein, adjacent and parallel with respective said guide slots thereon.

6. A barette according to claim 3, wherein:

a generally rectangular aperture is formed on each said folded section at a roughly central position over said receiving space therein;

a first said retaining surface of said hinge and locking insert is defined by an incised, generally rectangular and resilient snap fit tab formed at a predetermined position on said hinge insert and said locking insert, said snap fit tab being upwardly inclined and adapted to engage on edge portion of said aperture over a corresponding said receiving space when said hinge insert or locking insert is disposed therein;

a second said retaining surface of said hinge and locking insert is defined by a respective upturned, curled rim formed on the inner edge of said hinge insert and said locking insert, each said rim engaging an inner edge portion of a corresponding said folded section over said entrance slit thereof.

7. A barette for clipping hair comprising a first and second arcuate, elongate members pivotably attached to each other on corresponding end portions thereof with at least said first member being formed from and assembled by metal stamping operations, wherein:

a folded section is formed on each lateral end portion of said first member by folding over the terminal end portions of a sheet metal strip from which said first member is formed so as to be in abutment with the top surface thereof;

a raised portion embossed on each said folded section defines a respective pair of receiving spaces thereon, each said receiving space having an entrance slit formed near and parallel to an outer edge of a corresponding said folded section;

a hinge insert adapted to be received within a first said receiving space has a pair of upwardly projecting extensions formed on respective opposing sides thereof parallel with the longitudinal dimension of said first member, each said extension having a pivot hole thereon for the pivotable securement of a corresponding end of said second member;

a locking insert adapted to be received within a second said receiving space has cooperating resilient catch surfaces formed thereon adapted for engaging a latching means provided on a corresponding end of said second member; and retaining surfaces on said hinge insert and said locking insert engage cooperating surfaces on respective said receiving spaces to effect the securement of said hinge and locking inserts therein.

8. A barette according to claim 7, wherein two pairs of incised retaining tabs are formed under respective said folded sections at predetermined positions on opposing edges of said first member parallel with the longitudinal direction thereof, and a pair of notches are formed on respective opposing edges of each said folded section near the inner edge thereof being in registry with a corresponding pair of said retaining tabs, said retaining tabs being folded over and in abutment with the upper surface of said folded section.

9. A barette according to claim 7, wherein said receiving spaces, said hinge insert, and said locking insert have a generally rectangular form.

10. A barette according to claim 9, wherein a pair of guide slots are formed on opposing sides of each said receiving space parallel with the direction of insertion of said hinge and locking inserts therein, for receiving respective said extensions on corresponding said hinge and locking inserts.

11. A barette according to claim 10, wherein a pair of raised embossed grooves are formed on each said folded section over said receiving space therein, adjacent and parallel with respective said guide slots thereon.

12. A barette according to claim 9, wherein:

a generally rectangular aperture is formed on each said folded section at a roughly central position over said receiving space therein;

a first said retaining surface of said hinge and locking insert is defined by an incised, generally rectangular and resilient snap fit tab formed at a predetermined position on said hinge insert and said locking insert, said snap fit tab being upwardly inclined and adapted to engage on edge portion of said aperture over a corresponding said receiving space when said hinge insert or locking insert is disposed therein;

a second said retaining surface of said hinge and locking insert is defined by a respective upturned, curled rim formed on the outer edge of said hinge insert and said locking insert, each said rim engaging an outer edge portion of a corresponding said folded section over said entrance slit thereof.

13. A barette for clipping hair comprising a first and second arcuate, elongate members pivotably attached to each other on corresponding end portions thereof with at least said first member being formed from and assembled by metal stamping operations, wherein:

a folded section is formed on each lateral end portion of said first member by folding across opposing lateral protrusions of a sheet metal strip from which said first member is formed so as to be in abutment with the top surface thereof with the inner edges of each said lateral protrusion in mutual proximity;

a raised portion embossed on each inner edge portion of each said lateral protrusion defines a receiving space in each said folded section, each said receiving space having an entrance slit formed near and parallel to an outer edge of a corresponding said folded section;

a hinge insert adapted to be received within a first said receiving space has a pair of upwardly projecting extensions formed on respective opposing sides thereof parallel with the longitudinal dimension of said first member, each said extension having a pivot hole thereon for the pivotable securement of a corresponding end of said second member;

a locking insert adapted to be received within a second said receiving space has cooperating resilient catch surfaces formed thereon adapted for engaging a latching means provided on a corresponding end of said second member; and retaining surfaces on said hinge insert and said locking insert engage cooperating surfaces on respective said receiving spaces to effect the securement of said hinge and locking inserts therein.

14. A barette according to claim 13, wherein adjacent to each folded section a pair of incised retaining tabs are formed at predetermined positions inwards from opposing edges of said first member parallel with the longitudinal direction thereof, said retaining tabs being folded over the edge portions of respective said lateral protrusions opposite from a corresponding terminal end of said clamp member.

15. A barette according to claim 13, wherein said receiving spaces, said hinge insert, and said locking insert have a generally rectangular form.

16. A barette according to claim 15, wherein a pair of guide slots are formed in respective said lateral protrusions of each said folded section on opposing sides of each said receiving space therein parallel with the direction of insertion of said hinge and locking inserts therein, for receiving respective said extensions on corresponding said hinge and locking inserts.

17. A barette according to claim 16, wherein:

a generally rectangular aperture is formed on each said folded section at a roughly central position over said receiving space therein;

a first said retaining surface of said hinge and locking insert is defined by an incised, generally rectangular and resilient snap fit tab formed at a predetermined position on said hinge insert and said locking insert, said snap fit tab being upwardly inclined and adapted to engage an edge portion of said aperture over a corresponding said receiving space when said hinge insert or locking insert is disposed therein;

a second said retaining surface of said hinge and locking insert is defined by a respective upturned, curled rim formed on the outer edge of said hinge insert and said locking insert, each said rim engaging an outer edge portion of a corresponding said folded section over said entrance slit thereof;

a generally T shaped bar is formed centrally on the inner edges of respective said hinge insert and said locking insert, each said bar is disposed in the gap between corresponding said lateral protrusions and aids in preventing said lateral protrusions from spreading apart.

18. A barette for clipping hair comprising a first and second arcuate, elongate members pivotably attached to each other on corresponding end portions thereof with at least said first member being formed from and assembled by metal stamping operations, wherein:

a folded section is formed on each lateral end portion of said first member by folding over the terminal end portions of a sheet metal strip from which said first member is formed so as to be in abutment with the top surface thereof;

a raised portion embossed on each said folded section defines a respective pair of receiving spaces thereon, each said receiving space having an entrance slit formed along a lateral edge of a corresponding said folded section in a direction parallel with a longitudinal dimension of said clamping member;

a hinge insert adapted to be received within a first said receiving space has a pair of upwardly projecting extensions formed on respective opposing sides thereof parallel with the longitudinal dimension of said first member, each said extension having a pivot hole thereon for the pivotable securement of a corresponding end of said second member;

a locking insert adapted to be received within a second said receiving space has cooperating resilient catch surfaces formed thereon adapted for engaging a latching means provided on a corresponding end of said second member; and retaining surfaces on said hinge insert and said locking insert engage cooperating surfaces on respective said receiving spaces to effect the securement of said hinge and locking inserts therein.

19. A barette according to claim 18, wherein two pairs of incised retaining tabs are formed under respective said folded sections at predetermined positions on opposing edges of said first member parallel with the longitudinal direction thereof, and a pair of notches are formed on respective opposing edges of each said folded section near the inner edge thereof being in registry with a corresponding pair of said retaining tabs, said retaining tabs being folded over and in abutment with the upper surface of said folded section.

20. A barette according to claim 18, wherein said receiving spaces, said hinge insert, and said locking insert have a generally rectangular form.

21. A barette according to claim 20, wherein a rectangular guide slot is formed on each said folded section in a roughly central position over said receiving space therein extending perpendicularly inward from said entrance slit parallel with the direction of insertion of said hinge and locking inserts therein, for receiving respective said extensions on corresponding said hinge and locking inserts.

22. A barette according to claim 21, wherein:

a pair of generally rectangular elongate apertures are formed on each said folded section over said receiving space therein to either side of said guide slot and parallel therewith;

a pair of retaining surfaces of said hinge and locking insert are defined by incised, generally rectangular and resilient snap fit tabs formed at predetermined positions on said hinge insert and said locking insert, said snap fit tabs being upwardly inclined and adapted to engage an edge portion of respective said apertures over a corresponding said receiving space when said hinge insert or locking insert is disposed therein.

23. A barette according to claim 22, wherein a pair of indentations are formed on opposing corner portions of said hinge insert and said locking insert on lateral edges thereof adjacent to corresponding said entrance slits, for preventing wobbling of said hinge insert and said locking insert in corresponding said receiving spaces.

* * * * *